United States Patent [19]

Goettl

[11] Patent Number: 4,673,537

[45] Date of Patent: Jun. 16, 1987

[54] TRAP FOR THE SUMP DRAIN OF AN EVAPORATIVE COOLER

[76] Inventor: Adam D. Goettl, 4960 E. Palomino Rd., Phoenix, Ariz. 85018

[21] Appl. No.: 870,405

[22] Filed: Jun. 4, 1986

[51] Int. Cl.[4] ..... B01F 3/04

[52] U.S. Cl. ..... 261/97; 141/329; 137/797

[58] Field of Search ..... 261/97, DIG. 46; 141/329, 330; 137/797, 247.33, 247.27

[56] References Cited

U.S. PATENT DOCUMENTS

| | | | |
|---|---|---|---|
| 395,313 | 1/1889 | Clouette | 137/247.33 |
| 1,489,201 | 4/1924 | Freeze | 137/247.27 |
| 2,089,231 | 8/1937 | Uline | 137/247.27 |
| 2,687,829 | 8/1954 | Horrocks | 141/329 |
| 3,228,665 | 1/1966 | Dolan | 261/DIG. 46 |
| 3,470,893 | 10/1969 | Nelson | 137/797 |
| 4,173,858 | 11/1979 | Cassia | 141/330 |
| 4,192,832 | 3/1980 | Goettl | 261/DIG. 46 |
| 4,289,713 | 9/1981 | Goettl | 261/DIG. 46 |
| 4,573,490 | 3/1986 | Kaletsky | 261/DIG. 46 |
| 4,576,013 | 3/1986 | Sperr et al. | 261/DIG. 46 |

*Primary Examiner*—Tim Miles

*Attorney, Agent, or Firm*—Herbert E. Haynes, Jr.

[57] ABSTRACT

A trap device for placement on the overflow standpipe provided in the sump of an evaporative cooler for blocking the high velocity inflow of sewer gasses or other contaminants through the standpipe into the cooler during operation thereof without interfering with the water draining functions of the standpipe. The trap device is in the form of an inverted cupshaped body which is mountable in substantially concentric relationship with the standpipe and has a closed top which is spaced above the top of the standpipe and an open bottom end which is submerged in the operational water supply contained in the sump of the evaporative cooler. The closed top of the trap device is provided with a knock-out plug so that the drain hose of a bleed-off system may be sealingly inserted therein when the cooler is so equipped.

17 Claims, 8 Drawing Figures

TRAP FOR THE SUMP DRAIN OF AN EVAPORATIVE COOLER

BACKGROUND OF THE INVENTION

1. Field of the Invention

This invention relates to evaporative coolers and more particularly to a trap device for use with the sump drain of an evaporative cooler which prevents high velocity inflow of sewer gasses, and/or other contaminating materials from being drawn through the sump drain into the evaporative cooler during operation thereof.

2. Description of the Prior Art

As is well known in the art, an evaporative cooler is a mechanism which is used to cool relatively warm dry ambient air by the evaporation principle and direct the cooled air into a home, business establishment or other point of use. A typical evaporative cooler includes a cabinet structure having at least one porous wettable pad through which the ambient air is drawn into the cabinet. An air handling device, such as a fan or centrifugal blower assembly, is mounted in the cabinet to produce a negative static pressure therein, which draws the air through the wettable pad, and directs the cooled air to the point of use. The cabinet structure includes a pan-shaped bottom which serves as a sump, or reservoir, for containment of a water supply which is used to wet the porous pad. A pump is provided in the sump for supplying water to a distribution plumbing system provided in the cabinet, and the plumbing system directs the water onto the top of the porous pad or pads. The water delivered to the pad passes downwardly therethrough under the influence of gravity, and that which is not lost because of evaporation, returns to the sump for recirculation. A water supply device, usually in the form of a float controlled shut off valve, is provided to initially fill the sump and replace that which is lost as a result of evaporation.

The pan-shaped sump is provided with a standpipe which has its open upper end above the normal water level of the sump and has its open lower end extending through the bottom of the sump. The standpipe is provided for overflow protection to drain excess water from the sump in the event of sticking of the water supply device and the like, and for other water draining purposes as will now be explained.

As a result of evaporation and the entry of contaminating matter into the cooler, the water supply becomes contaminated and most manufactures recommend that a bleed-off system be used. A bleed-off system is used to continuously bleed-off a relatively small amount of contaminated water to allow the water supply device to replace the bled-off water with fresh water. Such a bleed-off system usually includes a special fitting that is mounted in the water outlet line leading from the pump to the cooler's distribution plumbing system. The fitting has a restricted outlet to keep the amount of bled-off water relatively low, and the bled-off contaminated water is directed via a bleed-off tube to the standpipe for draining purposes.

As a result of the above described water draining functions of the standpipe, it is a common practice to provide a drain hose or pipe for conducting water from the lower end of the standpipe to a suitable disposal point. In that a drain hose or pipe, is not standard equipment provided by a cooler manufacturer, but is instead something that is provided by an installer or owner, the drain hose or pipe may be configured in various ways.

In most instances, evaporative coolers are mounted on the roof of a building that is to be cooled, and in most cases the drain hose, or pipe will conduct drain water from the cooler to a plumbing vent pipe of the type commonly found on building roofs and thereby dispose of the drain water in the building's sewer line. In other instances, the drain hose, or pipe will be configured to direct the drain water onto the ground adjacent the building. Even though it is undesirable, some coolers do not have bleed-off systems and in such cases, sometime the cooler's are installed without any drain hose or pipe.

The problem associated with the standpipes provided in the sumps of evaporative coolers is that an extremely high velocity inflow of sewer gasses, or other contaminants, as determined by the drain hose, or pipe used, will be sucked into the cooler through the drain and standpipe, due to the negative static pressure in the cooler whenever it is operating.

Of primary concern is the sucking of sewer gasses into the cooler in instances where the drain hose, or pipe, is configured to deposit drain water in the sewer system via the plumbing vent pipe. In cases where the drain hose, or pipe, is configured to deposit the drain water onto the ground, mosquitos and the bacteria associated with stagnant standing water can similarly be drawn into the cooler. In cases where no drain hose or pipe is provided, insects and anything else in the area of the lower open end of the standpipe can be sucked into the cooler.

To the best of my knowledge, no device has been devised or suggested which closes the standpipe of an evaporative cooler against high velocity inflow into the cooler of sewer gasses or other contaminants and yet does not block or otherwise hamper the normal water draining functions of the cooler's of the cooler's standpipe.

SUMMARY OF THE INVENTION

In accordance with the present invention, a special trap device is disclosed for use in conjunction with the overflow standpipe provided in the sump of an evaporative cooler. The trap device operates in conjunction with the standpipe to form a water seal which prevents high velocity inflow of sewer gasses or other contaminants through the standpipe into the cooler and yet does not restrict or in any way hamper the outflow of water from the cooler's sump.

The trap device has an inverted cup shaped body which is placed in a concentric position on the standpipe. The cup-shaped trap body is provided with means for demountably mounting the body so that the closed upper end thereof is in upwardly spaced relationship with respect to the open upper end of the standpipe. The body of the trap device is sized so as to provide an annular space between the periphery of the standpipe and the inside of the trap body, and the open lower end of the trap body is disposed below the normal water level of the cooler's sump, and above the bottom of the sump. In this manner the water in the sump of the cooler will stand in the annular space between the standpipe and the trap body and will be at the same level as it is in the sump. Therefore, the water will act like a seal which prevents the negative static pressure in the cooler cabinet from reaching the standpipe, and this, of course, prevents high velocity gas inflow through the standpipe into the cooler cabinet. In that the water in the annular space between the trap body and the standpipe is free to rise and fall with the water level of the sump, draining of water from the sump by means of the overflow standpipe can occur in the normal manner.

The means for demountably mounting the cup-shaped trap body in the above described position relative to the overflow standpipe can be accomplished in at least two ways. In the preferred embodiment, the cup-shaped body is molded or otherwise formed with radial ribs which depend from the closed upper end of the cup-shaped trap body toward the open lower end thereof. The ribs are of special configuration so that they rest atop the open upper end of the standpipe and center the trap body in the desired concentric position on the standpipe, and maintain the necessary spacing between the closed upper end of the trap body and the open upper end of the standpipe. In a second embodiment, the cup-shaped trap body is provided with legs which depend from the open lower end thereof and rest on the bottom surface of the sump. The depending legs hold the trap body up to provide the above mentioned spaced relationship of the trap body relative to the standpipe.

In any case, the cup-shaped trap body is provided with a knock-out plug means centrally in its closed upper end. The knock-out plug means is left in place whenever the evaporative cooler is operated without a bleed-off system as hereinbefore described. If a bleed-off system is to be used, the knock-out plug means is punched, drilled or otherwise removed, to provide a central opening into which the bleed-off hose is sealingly installed so that its outlet end will direct the contaminated water into the standpipe for disposal purposes.

Accordingly, it is an object of the present invention to provide a new and useful trap device for use on the overflow standpipe provided in the sump of an evaporative cooler.

Another object of the present invention is to provide a new and useful trap device for use on the overflow standpipe provided in the sump of an evaporative cooler which prevents the inflow of high velocity sewer gas, or other contaminants through the standpipe during operation of the evaporative cooler and will not interfere in any way with the normal water disposal functions of the overflow standpipe.

Another object of the present invention is to provide a new and useful trap device of the above described character which includes an inverted cup-shaped trap body with means for demountably mounting the trap body in spaced concentric relationship with the standpipe in a position wherein the closed upper end of the trap body is spaced upwardly from the open upper end of the standpipe, and the open lower end of the trap body is above the bottom of the sump but is below the normal water level of the sump of the evaporative cooler.

Another object of the present invention is to provide a new and useful trap device of the above described character wherein the closed upper end of the trap body is provided with a knock-out plug means which can be removed for sealingly receiving the outlet end of a bleed-off hose which directs bled-off contaminated water into the standpipe of the cooler for disposal purposes.

The foregoing and other objects of the present invention as well as the invention itself, may be more fully understood from the following description when read in conjunction with the accompanying drawings.

DESCRIPTION OF THE PREFERRED EMBODIMENTS

Figure 1:
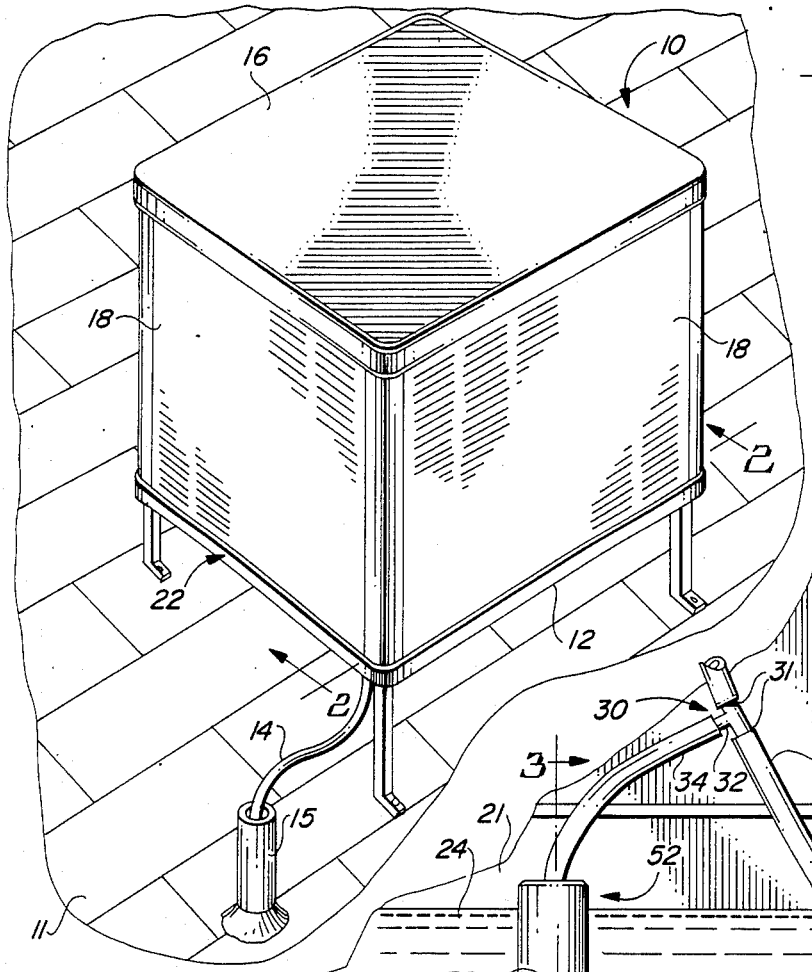
FIG. 1 is a fragmentary perspective view of a typical evaporative cooler and its installation on the roof of a building.

Referring more particularly to the drawings, FIG. 1 illustrates a typical evaporative cooler which is indicated in its entirety by the reference numeral 10. The cooler 10 is shown as having been installed on the roof 11 of a building (not shown) which is to be cooled by the evaporative cooler. The cooler 10 is customarily mounted on the roof 11 by a suitable stand 12 and, as will hereinafter be described in detail, the cooler 10 is shown as having a drain system such as the illustrated hose 14 extending therefrom into a plumbing vent pipe 15 of the type normally extending through the building's roof 11.

In that evaporative coolers per se are well known in the art, a detailed description thereof is deemed as being unnecessary. However, to insure a complete understanding of the present invention, a brief description of the typical evaporative cooler 10 will now be presented.

The evaporative cooler 10 includes a multi-sided cabinet 16 having a wettable porous pad assembly 18 demountably carried in each of its sides. It will be understood that some coolers have fewer than four pad assemblies. Warm and relatively dry ambient air is drawn through the wettable porous pad assemblies 18 into the interior of the cabinet 16 by operation of an air handling mechanism 20, such as the illustrated centrifugal blower which creates a negative static pressure in the cabinet 16. When the ambient air passes through the wet pad assemblies 18, the air will be cooled by evaporation and drawn into the opposed axial air inlets (not shown) of the air handler means 20, and by means of blower action, will be directed from the centrifugal air outlet 21 into a cooled air distribution duct network (not shown) which is part of the building being cooled by the evaporative cooler.

Figure 2:
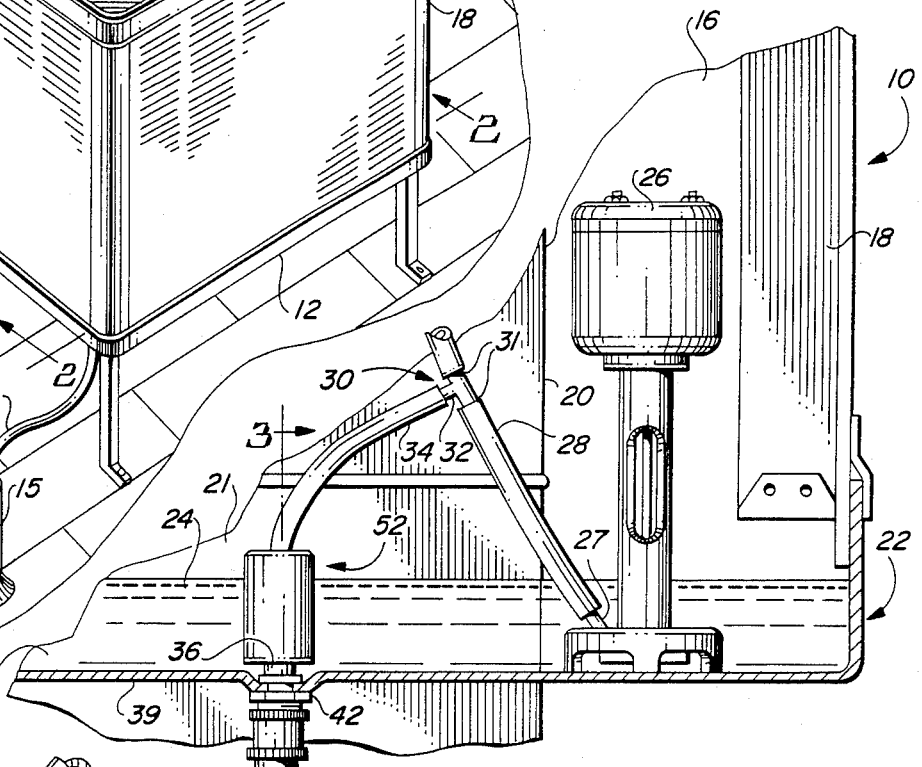
FIG. 2 is an enlarged fragmentary sectional view taken along the line 2—2 of FIG. 1.

As shown in FIG. 2, the entire bottom end of the cooler cabinet 16 is of pan-shaped configuration and serves as a sump 22 for containment of a water supply 23 which is employed for wetting of the cooler pad assemblies 18. The water supply 23 is initially supplied to the sump 22 of the evaporative cooler 10 by means of a water shut off valve (not shown) which is usually a float controlled mechanism that is coupled, for example, to a municipal water supply line (not shown). In addition to initially supplying water to the sump 22, the float controlled water shutoff valve (not shown) supplies make-up water to the supply 23 to replace that lost by evaporation and thereby maintain the water supply 23 at a substantially constant predetermined level 24.

A pump 26 is provided in the sump 22 of the cooler's cabinet 16 to supply water under pressure from the pump outlet 27 to a water distribution plumbing system 28 of the cooler 10. The plumbing system 28 includes a network of suitable distribution pipes (not shown) at the top of the cabinet 16 which distribute water to the top of each of the pad assemblies 18. The water supplied in this manner will flow down through the pad assemblies 18 under the influence of gravity of thereby maintain the pad in a wet condition. The water that is not lost as a result of evaporation as it flows down through the pad assemblies 18 will return to the water supply 23 for recirculation.

Due to evaporation, evaporative coolers are subject to severe mineral build-up problems which coats all of the components and internal surfaces of the cooler with mineral content of the water supply. To help control the mineral build-up problem and other water contamination problems, many manufactures supply a bleed-off system with each cooler and such systems are available as after market add-ons. Bleed-off systems are very simple and includes a special tee 30 which is mounted in the plumbing system 28 of the cooler downstream of the outlet 27 of the pump 26. The aligned bosses 31 of the tee 30 are configured to allow a full flow of water through the plumbing system 28 but the other boss 32, which extends normally from the aligned bosses 31, is of restricted size so that a relatively small amount of water will flow through the boss 32 into a bleed-off drain tube 34 which carries the contaminated bled-off water to a suitable disposal point, as will hereinafter be described in detail.

Figure 3:
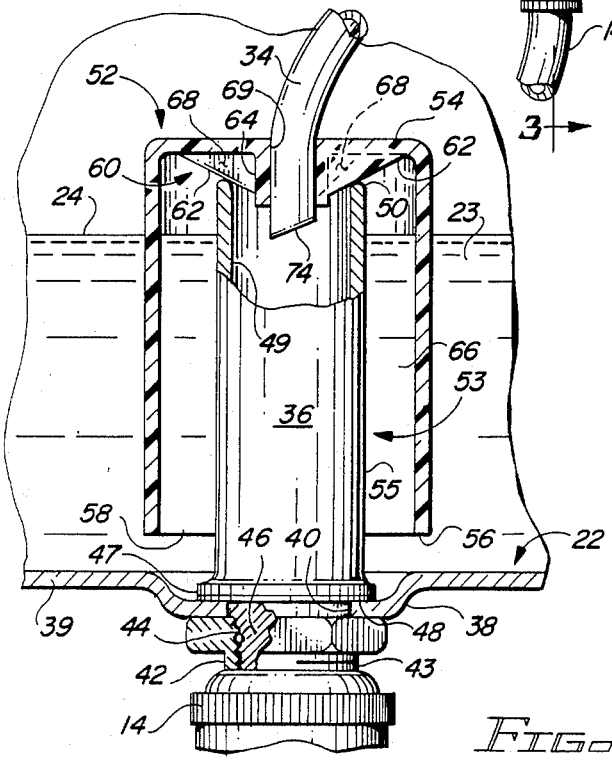
FIG. 3 is an enlarged fragmentary sectional view taken along the line 3—3 of FIG. 2 showing the structural details of a first embodiment of the trap device of the present invention.

In addition to the above described elements of the evaporative cooler 10, an overflow standpipe 36 is mounted in the sump 22 to drain off any excess water which may result from sticking of the float controlled water supply shutoff valve (not shown) or the like. As shown best in FIG. 3, the sump 22 is formed with a downwardly upset dimple portion 38 at a convenient location in the bottom 39 of the sump 22 and an aperture 40 is formed through the dimple portion. A drain fitting 42 is welded or otherwise attached to the lower surface of the sump's bottom 39 at the aperture 40 thereof. The drain fitting 42 is externally threaded as indicated at 43 so that the previously mentioned drain hose 14, or the like, may be attached thereto. The drain fitting 42 is also internally threaded as at 44 for demountable attachment of the standpipe 36 thereto. The standpipe 36, which is usually molded of a synthetic resin, is provided with an externally threaded lower end 46 which is passed through the aperture 40 of the sump's bottom 39 into threaded engagement with the drain fitting 42. An annular flange 47 is formed on the standpipe 36 so as to interact with a suitable gasket 48 to sealingly engage the upper surface of the sump's bottom 39 and thereby form a leakproof seal. As shown in FIG. 3, the standpipe 36 is formed with an axial bore 49 with the open upper end being defined by a circular rim 50.

The hereinbefore mentioned drain hose 14 is not part of the evaporative cooler 10 per se, but it is the usual way that waste water is conducted away from the cooler to a suitable disposal point. In most instances, as hereinbefore described, the drain hose is placed so that it communicates with the hereinbefore mentioned plumbing vent pipe 15 of the building, as shown in FIG. 1 so that the waste water is deposited directly into the sewage system via the vent pipe.

As hereinbefore described, the air handler device 20 creates a negative static pressure in the cabinet 16 of the evaporative cooler. As a result of this sewer gas, or other contaminating materials if the drain system is other than as illustrated, will be drawn through the standpipe 36 into the cooler cabinet and the gas will be at an extremely high velocity in that the standpipe is open whereas the pad assemblies 18 do present a resistance to incoming air flow.

In accordance with the present invention, a trap device, which is indicated generally by the reference numeral 52, is provided to overcome the above described problems associated with the inflow of high velocity sewer gas, or other contaminating substances through the standpipe 36. As seen in FIGS. 2, 3, 4 and 5, wherein a first embodiment of the present invention is shown, the trap device 52 includes an inverted cup-shaped body 53 having a closed top end 54, such as of circular configuration, with a depending endless skirt 55 having a circular rim 56 which defines the open bottom end 58 of the trap device. The interior surface of the top end 54, that is, the one which faces toward the open bottom end 58, is molded or otherwise formed with standoff means 60 which mounts the trap device 52 on the standpipe 36. The standoff means 60 is in the preferred form of plural ribs 62 which extend in radially spaced relationship from a central boss 64 that depends from the top end 54. Each of the ribs 64 slope angularly and downwardly from the periphery of the internal surface of the top end 54 to the central boss 64, and the ribs rest on the top rim 50 of the standpipe 36. The angular disposition of the ribs 64 will tend to center the trap device 52 on the standpipe 36 and hold the top end 54 in upwardly spaced relationship with respect to the open top end of the standpipe.

The trap device 52 has an inside diameter which is considerably larger than the outside diameter of the standpipe 36 so that when the trap device is substantially concentrically mounted as shown and described above, and an annular opening 66 exists between the trap skirt 55 and the standpipe. Therefore, the water supply 23 of the evaporative cooler is free to enter through the open bottom end 58, which is supported in a position between the bottom 39 of the sump 22 and the normal water level line 24, and seek a water level within the tap device 52 which is substantially equal to the water level line 24.

As a result of this, the water in the trap device 52 acts as a seal so that the negative static pressure within the cooler cabinet 16 will not be felt in the upper portion of the trap device or in the standpipe 36.

If, as hereinbefore mentioned, an overflow condition should occur in the evaporative cooler 10, as a result of a sticking supply water shutoff valve (not shown) for example, the water level line 24 in the sump 22 will slowly rise and the water in the trap device will rise with it. When the rising water level reaches the rim 50 of the standpipe 36, it will spill over the rim into the standpipe 36 via the spaces 68 between the radial ribs 62 of the standoff means 60. Thus, the trap device 52 will not interfere with the normal overflow protection function of the standpipe.

Figure 4:
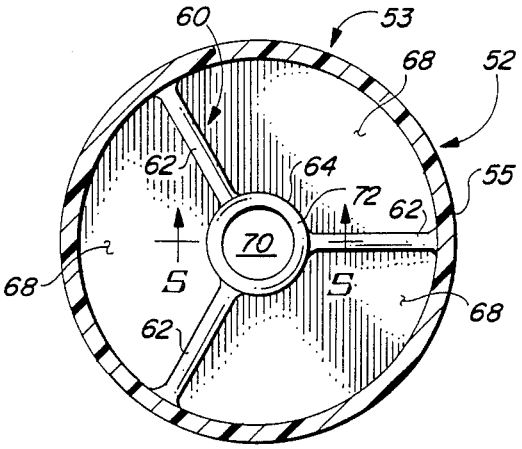
FIG. 4 is an enlarged sectional view taken on a horizontal plane showing the internal configuration of the closed upper end of the trap device prior to its having been modified to receive the outlet end of a bleed-off drain hose of the evaporative cooler.
Figure 5:
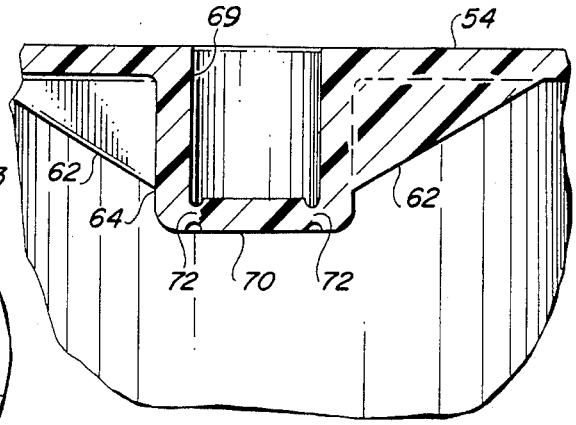
FIG. 5 is an enlarged fragmentary sectional view taken along the line 5—5 of FIG. 4.

As shown in FIGS. 4 and 5, the depending central boss 64 of the trap device 52 has an axial bore 69 formed therethrough which is open at its top end and closed on its bottom by means of what may be described as a knock-out plug 70. The plug 70 is preferably molded integrally with the trap device and is attached to the lower end of the boss 64 by means of an annular thin wall web 72. The knock-out plug 70 could, obviously, be provided in other ways, such as by forming a separate plug (not shown) which is pushed into the axial bore 69 in an interference fit manner to form an air tight seal therein.

In any event, the trap device 52 is supplied by the manufacturer with the knock-out plug means 70 in place within the axial bore 69 of the central boss 64 and will be used in this way if the evaporative cooler 10 is not equipped with a bleed-off system as described above. When the cooler has a bleed-off system, the knock-out plug means 70 is punched, drilled, pushed or otherwise removed to open the axial bore 69 and the discharge end 74 of the bleed-off drain tube 34 is sealingly inserted in an airtight manner as shown in FIG. 3. In this way, the bled-off waste water will be directed to the standpipe 36 and carried away to the disposal point as hereinbefore described.

Figure 6:
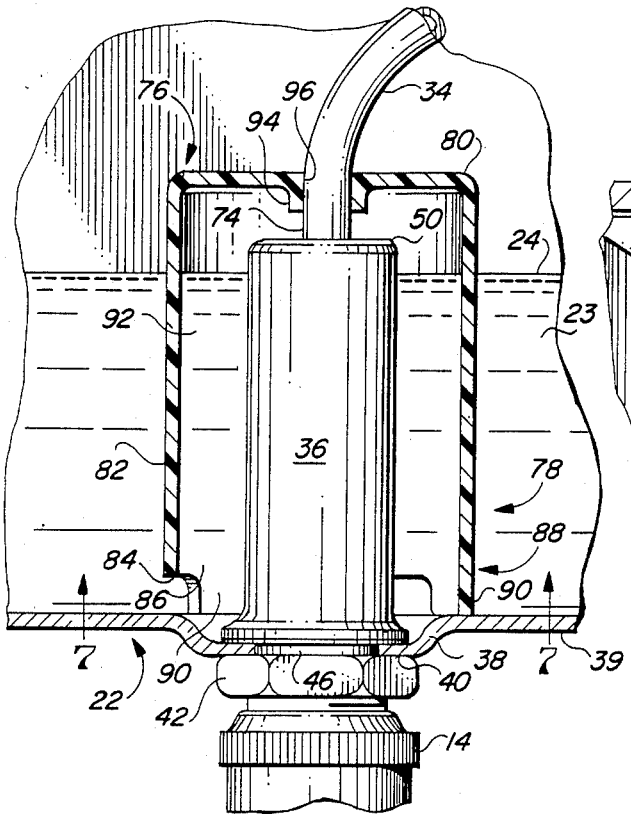
FIG. 6 is a sectional view similar to FIG. 3 showing the structural details of a second embodiment of the trap device of the present invention.
Figure 7:
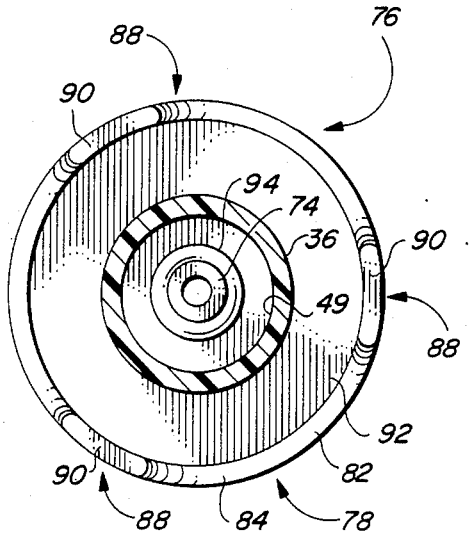
FIG. 7 is an enlarged sectional view taken along the line 7—7 of FIG. 6.
Figure 8:
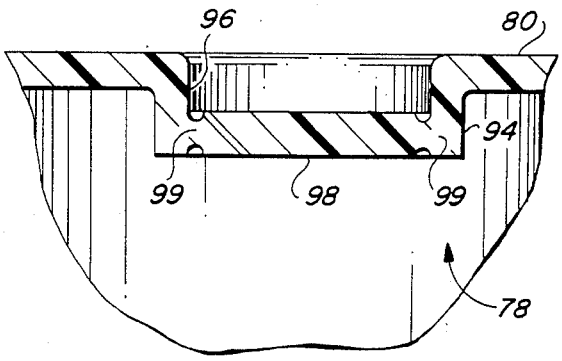
FIG. 8 is an enlarged fragmentary sectional view taken on a vertical plane through the closed upper end of the trap device of this second embodiment to show it prior to its having been modified to receive the outlet end of a bleed-off drain hose of the evaporative cooler.

Reference is now made to FIGS. 6, 7 and 8 wherein a second embodiment of the trap device of the present invention is indicated generally by the reference numeral 76. As was the case with the above described trap device 52, this second embodiment includes an inverted cup-shaped body 78 having a closed top end 80 with a depending endless skirt 82 having a bottom rim 84 which defines an open bottom end 86 of the trap device 76. The trap device 76 is formed with a standoff means 88 which is in the preferred form of a plurality of legs 90 which extend from the bottom rim 84 of the skirt portion 82 of the cup-shaped body 78.

As shown in FIG. 6, the standoff legs 90 rest on the bottom 39 of the sump 22 to support the trap body 78 so that the bottom rim 84 thereof is spaced above the bottom 39 of the sump 22 and is below the normal water level line 24 of the water supply. Also, the legs 90 support the trap device 76 so that its closed top end 80 is spaced above the circular rim 50 of the standpipe 36. And, the trap body 78 is sized to provide the annular space 92 between the periphery of the standpipe 36 and the endless skirt 82.

Therefore, it will be appreciated that the second trap device 76 will function in exactly the same manner as the hereinbefore fully described first embodiment of the present invention, and for that reason, the function of the second embodiment will not be repeated.

As shown in FIG. 8, a depending boss 94 is formed centrally on the closed top end 80 of the cup-shaped trap body 78, and the depending boss has an axial bore 96 formed therein which is open at its top end and closed at its bottom end by a knock-out plug means 98. The trap device 76 is supplied with the knock-out plug means 98 therein, which is secured in place such as by means of an annular thin-wall web 99 which allows the knock-out plug means 98 to be left in place if the evaporative cooler 10 is not supplied with the above described bleed-off system, and allows it to be removed for receiving the discharge end 74 of the bleed-off drain to be 34 if the evaporative cooler is so equipped.

While the principles of the invention have now been made clear in the illustrated embodiments, there will be immediately obvious to those skilled in the art, many modifications of structure, arrangements, proportions, the elements, materials and components used in the practice of the invention and otherwise, which are particularly adapted for specific environments and operation requirements without departing from those principles. The appended claims are therefore intended to cover and embrace any such modifications within the limits only of the true spirit and scope of the invention.

What I claim is:

1. A trap device for use with an evaporative cooler of the type having a sump in the bottom thereof for containment of an operational water supply and having an open overflow standpipe in the sump, said trap device comprising:

(a) a body of inverted cup-shaped configuration having a closed top end and an open bottom end;

(b) standoff means on said body for positioning said body in spaced substantially concentric relationship with the standpipe of the evaporative cooler with the closed top end of said body in upwardly spaced relationship with the top of the standpipe and the open bottom end of said body positioned between the bottom of the sump of the evaporative cooler and the normal water level line of the sump; and (c) knock-out plug means located centrally in the closed top end of said body for selective removal to provide an opening through the closed top end of said body.

2. A trap device as claimed in claim 1 wherein said standoff means comprises a plurality of ribs which depend in spaced apart relationship from the closed top end of said body for resting engagement on the top of the standpipe of the evaporative cooler.

3. A trap device as claimed in claim 1 wherein said standoff means comprises:

(a) a boss depending centrally from the closed top end of said body; and (b) a plurality of ribs depending from the closed top end of said body and extending in radially spaced apart relationship from said boss to the periphery of the closed top end of said body, said ribs being for resting engagement on the top of the standpipe of the evaporative cooler.

4. A trap device as claimed in claim 3 wherein each of said plurality of ribs slopes angularly and downwardly from the periphery of the closed top of said body to said boss.

5. A trap device as claimed in claim 3 wherein said boss defines an axial bore which extends from the upper surface of the closed top of said body to the lower end of said boss, said axial bore of said boss being closed by said knock-out plug means which allows opening of the axial bore of said boss.

6. A trap device as claimed in claim 3 wherein said boss defines an axial bore which opens onto the upper surface of the closed top end of said body and is closed on its bottom end by said knock-out plug means which allows opening of the axial bore of said boss.

7. A trap device as claimed in claim 1 wherein said standoff means comprises a plurality of legs depending in spaced apart relationship from said body for resting engagement on the bottom of the sump of the evaporative cooler.

8. A trap device as claimed in claim 7 wherein said body further comprises a boss depending centrally from the closed top end of said body and defining an axial bore which extends between the upper surface of the closed top end of said body and the lower end of said boss, said axial bore of said boss being closed by said knock-out plug means which allows opening of said axial bore of said boss.

9. A trap device as claimed in claim 7 wherein said body further comprises a boss depending centrally from the closed top end of said body and defining an axial bore which opens onto the upper surface of the closed top end of said body and is closed on its bottom end by said knock-out plug means for allowing opening of the axial bore of said boss.

10. An evaporative cooler comprising in combination:

(a) an evaporative cooler having a cabinet with a pan-shaped sump in the bottom thereof for containment of an operational water supply;

(b) an overflow standpipe in the sump of the cabinet of said evaporative cooler, said standpipe defining an axial bore, and (c) a trap device mounted in substantially concentric relationship with said standpipe to prevent an inflow of sewer gasses or other contaminants through said standpipe into the cabinet of said evaporative cooler when said evaporative cooler is being operated; said trap device including, I. a body of inverted cup-shaped configuration having a closed top end and an open bottom end, II. standoff means on said body for positioning said body in the substantially concentric relationship with respect to said standpipe with the closed top end of said body in upwardly spaced relationship with the top of said standpipe and the open bottom end of said body being disposed between the bottom of the sump of said evaporative cooler and the normal water level line of the sump, III. a knock-out plug means located centrally in the closed top end of said body for selective removal to form an opening through the closed top end of said body.

11. An evaporative cooler as claimed in claim 10 wherein said standoff means comprises a plurality of ribs which depend in spaced apart relationship from the closed top end of said body in resting engagement on the top of said standpipe.

12. A evaporative cooler as claimed in claim 10 and further comprising:

(a) said evaporative cooler having a bleed-off system with a drain tube for bleeding off a relatively small amount of the operational water supply of said evaporated cooler during operation thereof;

(b) said body having said knock-out plug means removed to form the opening through the closed top end thereof; and (c) said drain tube of said bleed-off system of said evaporative cooler having a discharge end which is located in the opening formed through the closed top end of said body for directing the bled-off water from said bleed-off system into said standpipe.

13. An evaporative cooler as claimed in claim 10 wherein said standoff means comprises:

(a) a boss depending centrally from the closed top end of said body; and (b) a plurality of ribs depending from the closed top end of said body and extending in radially spaced apart relationship from said boss to the periphery of the closed top end of said body, said ribs being in resting engagement on the top of said standpipe.

14. An evaporative cooler as claimed in claim 13 wherein each of said plurality of ribs slopes angularly and downwardly from the periphery of the closed top end of said body to said boss.

15. An evaporative cooler as claimed in claim 13 wherein said boss defines an axial bore which extends between the upper surface of the closed top of said body and the lower end of said boss, said axial bore of said boss being closed by said knock-out plug means by which said axial bore of said boss may be selectively opened.

16. An evaporative cooler as claimed in claim 10 wherein said standoff means comprises a plurality of legs depending in spaced apart relationship from said body in resting engagement on the bottom of the sump of said evaporative cooler.

17. An evaporative cooler as claimed in claim 16 wherein said body further comprises a boss depending centrally from the closed top end of said body and defining an axial bore which extends between the upper surface of the closed top end of said body and the lower end of said boss, said axial bore of said boss being closed by said knock-out plug means by which the axial bore of said boss may be selectively opened.

* * * * *